US005806417A

United States Patent [19]

Whiten et al.

[11] Patent Number: 5,806,417

[45] Date of Patent: Sep. 15, 1998

[54] SHELF-MOUNTING ASSEMBLY

[75] Inventors: James Douglas Whiten; Dennis E. Parham, both of Kennesaw, Ga.

[73] Assignee: The Mead Corporation, Dayton, Ohio

[21] Appl. No.: 794,943

[22] Filed: Feb. 4, 1997

[51] Int. Cl.[6] ..... A47B 9/00

[52] U.S. Cl. ..... 108/106; 211/191

[58] Field of Search ..... 108/106, 109, 108/110, 153.1, 154, 147.12, 147, 11, 137, 143; 211/190, 191, 208; 248/220.22, 221.11, 219.1, 219.3

[56] References Cited

U.S. PATENT DOCUMENTS

| | | | |
|---|---|---|---|
| 619,418 | 2/1899 | Hunter | 108/110 |
| 1,336,971 | 4/1920 | Levene | 108/109 |
| 2,218,144 | 10/1940 | Vineyard . | |
| 3,050,194 | 8/1962 | Sinninger | 108/106 |
| 3,536,015 | 10/1970 | Textoris | 108/147.11 X |
| 3,862,691 | 1/1975 | Mori et al. | 211/191 |
| 4,105,126 | 8/1978 | Deffner et al. . | |
| 4,128,177 | 12/1978 | Bustos . | |
| 4,201,139 | 5/1980 | Suttles | 108/109 |
| 4,240,557 | 12/1980 | Dickens . | |
| 4,519,508 | 5/1985 | Gullett et al. . | |
| 4,598,828 | 7/1986 | Young et al. . | |
| 4,646,658 | 3/1987 | Lee . | |
| 4,720,016 | 1/1988 | Kay . | |
| 4,809,855 | 3/1989 | Bustos . | |
| 4,817,900 | 4/1989 | Whittington et al. . | |
| 5,205,421 | 4/1993 | Bustos . | |
| 5,632,389 | 5/1997 | Rosenband | 108/109 X |

*Primary Examiner*—Jose V. Chen
*Attorney, Agent, or Firm*—Tsugihiko Suzuki

[57] ABSTRACT

A shelf mounting assembly comprises front and rear opposed uprights and an adapter member on which a shelf is mounted. Each upright has engaging slots vertically disposed at spacings. The adapter member extends between the uprights and connected to the same by one or more of the engaging slots of each upright. This allows the adapter member to be supported at a selected elevation. The adapter member comprises a shelf-mounting flange for detachably and movably connecting a shelf to the adapter member so that the shelf may be mountable at different positions along the adapter member.

18 Claims, 4 Drawing Sheets

SHELF-MOUNTING ASSEMBLY

BACKGROUND OF THE INVENTION

This invention relates to merchandising shelf devices for displaying articles such as bottles, cans, bricks, cartons, bags or the like, and particularly to a shelf-mounting assembly useful in mounting a display shelf on different sized supporting structures such as those built into display coolers and refrigerators. The invention further relates to a method of mounting a shelf on supporting structures of different sizes.

Display shelf devices have been used both in warm and cold vaults to merchandise a number of products. These devices are composed of shelves and a supporting structure on which the shelves are mounted in a tiered relationship. A typical example of a supporting structure is a four-post structure comprising two pairs of front and rear uprights. Each upright is located at a certain distance from the adjacent upright so that the uprights are in an arrangement suitable for supporting the shelves of a particular size.

In retail stores, it is common that the shelf devices are periodically replaced by new ones to promote different products or to redecorate the store interiors. However, replacement of those devices in cold vaults in particular is not always easy. In most of small and intermediate display coolers/refrigerators, the shelf-supporting structures are built-in and thus are not replaceable. These built-in supporting structures are not compatible with different sized shelves. For these reasons, it is often required that entire coolers or refrigerators be replaced to install new shelf devices.

What is needed, therefore, is a shelf-mounting system which allows use of existing shelf-supporting structures upon installment of new shelf devices. Such a system should allow new shelves to be easily mounted on existing supporting structures of various sizes.

SUMMARY OF THE INVENTION

The present invention provides a shelf-mounting assembly which comprises front and rear opposed uprights and an adapter member on which a shelf is mounted. Each upright has engaging slots vertically disposed at spacings. The adapter member extends between the uprights and is connected to each upright by means of one or more of the engaging slots of that upright. The adapter member comprises shelf-mounting means for detachably and movably connecting a shelf to the adapter member so that the shelf may be mountable at different positions along the adapter member.

The mounting assembly of the invention is capable of supporting not only those shelves which have been designed and prepared particularly for the uprights but also those which have not. For example, uprights positioned too far away from or too close to each other to support a shelf can be transformed into a suitable supporting structure for the shelf, according to the invention. Further, the assembly of the invention allows a shelf to be mounted at a selected/desired position with respect to the uprights.

In a preferred embodiment, the assembly further comprises a supporting bracket detachably mounted in the aforementioned one or more engaging slots of each upright to support the lower edge of the adapter member. Each supporting bracket may have an upwardly projecting stopper tab. The stopper tab of at least one of the brackets is received in a stopper aperture formed in the adapter member to prevent horizontal displacement of the adapter member.

A preferred form of the shelf-mounting means is a lateral flange formed along the adapter member. The lateral flange has a plurality of apertures arranged along its length to receive fastening means that may be separate from or integral with a shelf to be mounted.

An alternative form of the shelf-mounting means may be a lateral flange formed with a slot extending therealong. Such a slot slidably receives fastening means which may be separate from or integral with a shelf to be mounted.

In either form, the lateral flange may define an acute angle with the lower edge of the adapter member. Such an arrangement is useful in supporting gravity feed shelves.

In another preferred embodiment, the assembly further comprises an extension member. The extension member is connected to the adapter member for movement along the length of the adapter member so that the substantial length of the adapter member may be adjustable.

The present invention also provides a merchandising device which comprises a shelf in addition to the front and rear uprights and the adapter member. The shelf-mounting means enables the shelf to be relocated to different positions along the adapter member.

A preferred form of the shelf comprises a pair of front and rear opposed cross members extending generally perpendicularly to the adapter member. Each cross member is connected at one of its opposite ends to the adapter member by the shelf-mounting means. The shelf may further comprise a track mounted on the front and rear cross members and disposed generally parallel to the adapter member. The track may be designed to support a row of articles such that when supported by the track, articles are movable along a the track and are removable from the track via the forward end of the track. The track may be held inclined forwardly and downwardly by means of the adapter member of which the lateral flange defines an acute angle with the lower edge.

The present invention further provides a method of mounting a shelf having a pair of front and rear opposed cross members onto a supporting structure having two pairs of front and rear opposed uprights. The method comprises the steps of mounting a supporting bracket in one or more of the engaging slots of each upright, securing a pair of adapter members to the shelf so that each adapter member interconnects the front and rear cross members at the respective ends of the front and rear cross members, and placing the shelf on the supporting brackets such that the lower edges of the adapter members are engaged and supported by the adapter members. According to this method, the shelf may be mounted on the supporting structure without adjusting the distance between the front and rear cross members.

The objects and advantages of the present invention will be apparent from the following description, the accompanying drawings and the appended claims.

DETAILED DESCRIPTION OF THE PREFERRED EMBODIMENT

Figure 1:
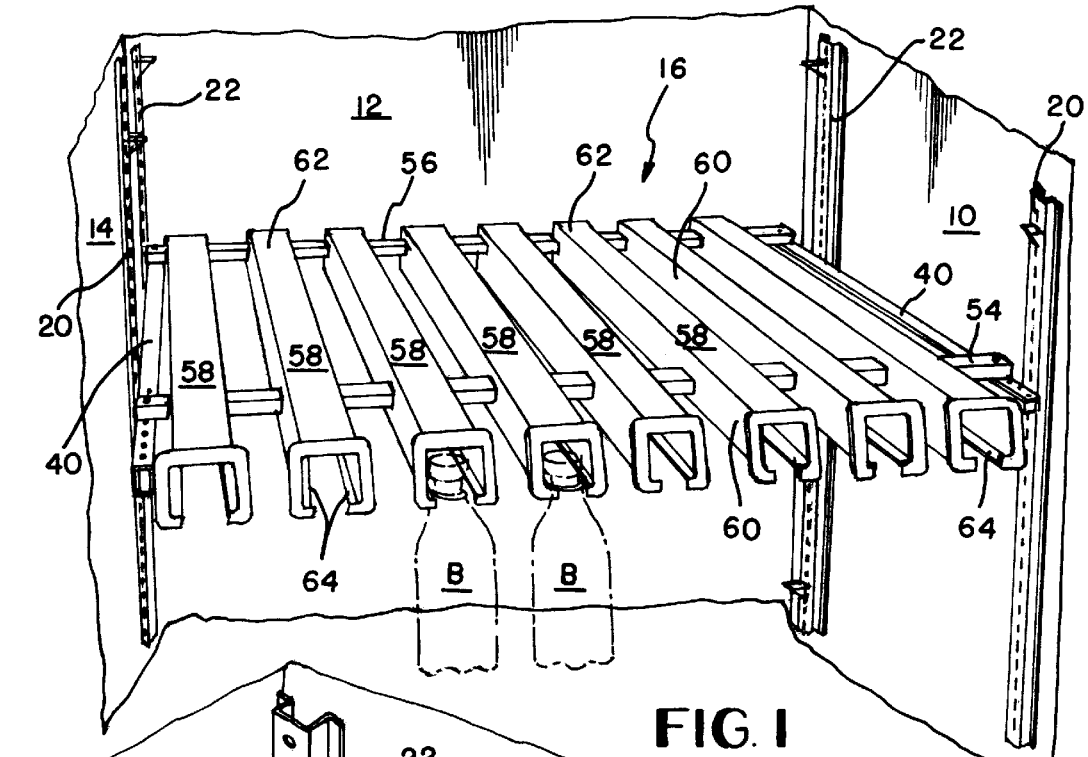
FIG. 1 is a perspective view of a merchandising device according to the invention, which device is installed in a display cooler/refrigerator.

FIG. 1 illustrates a merchandising device according to the invention. The illustrated device is a gravity feed device designed for dispensing bottles. The device is installed inside a single door cooler/refrigerator and is shown as viewed from the front side of the cooler. The door of the cooler is omitted for illustration purpose; however, such a door, a glass door preferably, is hinged to the cooler housing to close the front opening of the cooler. Reference numerals 10, 12 and 14 denote the inside walls of the cooler.

The device comprises a display shelf 16 removably mounted on a support assembly 18. The assembly 18 includes a supporting structure that is a conventional four-post structure having been built into the cooler. The supporting structure comprises two pairs of front and rear uprights 20 and 22. The uprights 20 and 22 of each pair are disposed alongside the respective one of the opposed inside walls 10 and 14 and secured to the same by suitable fastening means such as screws, rivets or the like. In FIG. 1, the device is shown as having only one shelf 16. However, it will in general have two or more display shelves 16 disposed in a tiered relationship.

Figure 2:
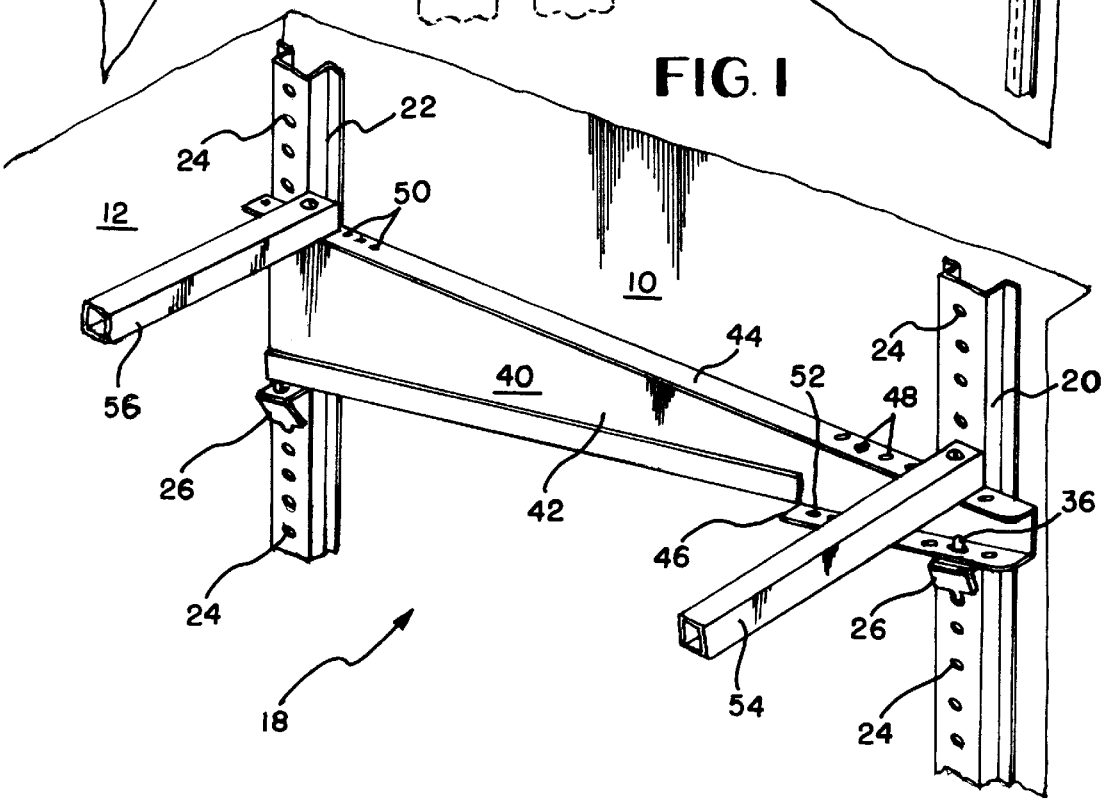
FIG. 2 is a fragmentary perspective view of a shelf-mounting assembly in FIG. 1.

The four uprights 20 and 22 are of a substantially identical structure formed with a number of engaging slots 24. Each upright 20 and 22 is formed of sheet metal folded into an elongate body having a generally U-shaped cross section. As shown in FIG. 2, the slots 24 of each upright 20 and 22 are formed in the side wall of that upright and arranged in a vertical row at equal spacings. As the uprights 20 and 22 of each pair are secured to the same inside wall, the slotted side walls of these uprights 20 and 22 lie in the same vertical plane.

Figure 3:
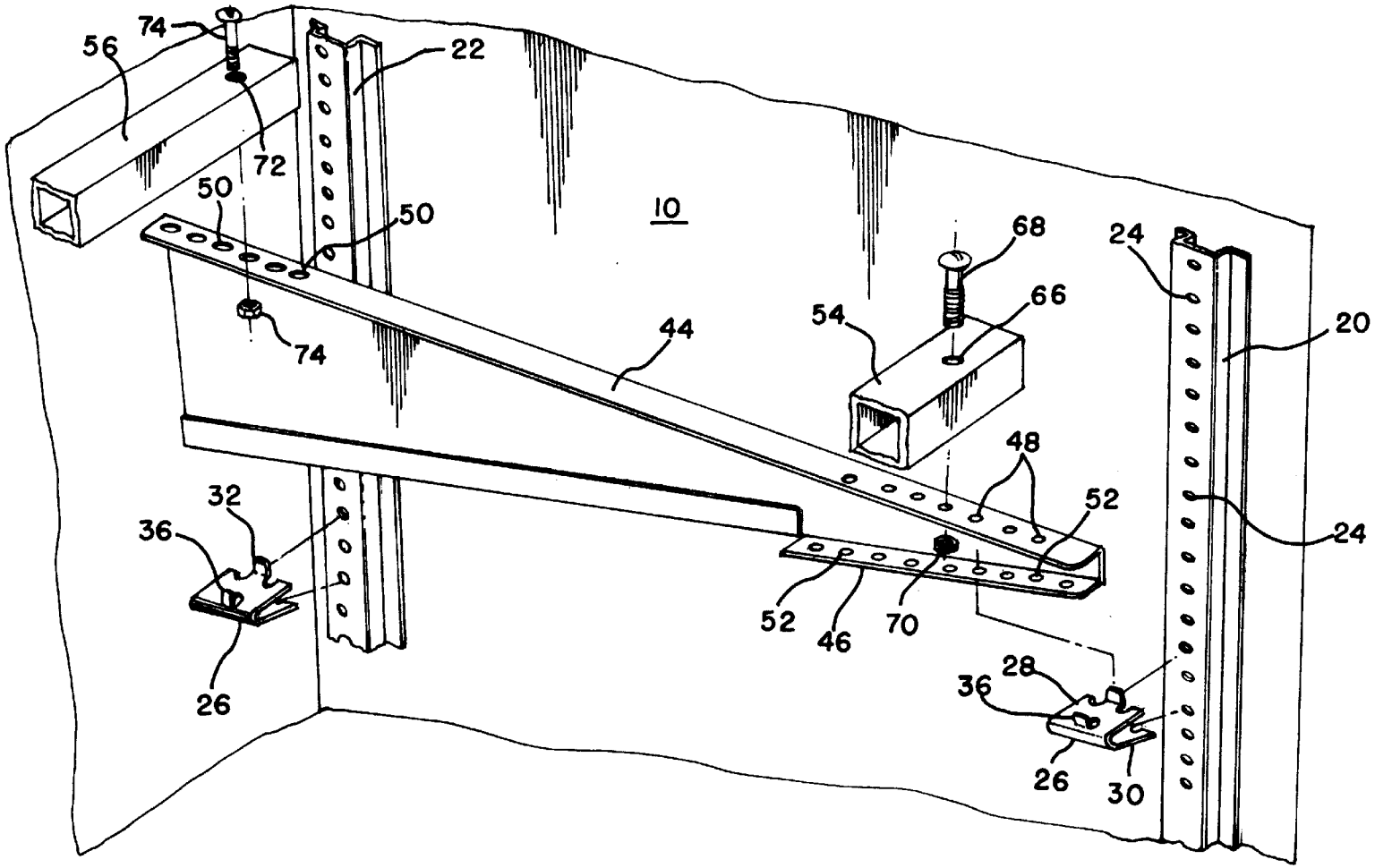
FIG. 3 is an exploded view of the mounting assembly in FIG. 2.

The assembly 18 further includes four conventional snap-in supporting brackets 26 (only two shown in FIGS. 2 and 3). The brackets 26 are mounted respectively on the four uprights 20 and 22 so that all the brackets 26 lie in the same horizontal plane. Each bracket 26 is formed preferably of sheet metal and comprises a pair of legs 28 and 30 joined together along their edges. The upper leg 28 is provided at its free edge with a toe 32 extending upward whereas the lower leg 30 is provided at its free edge with a heel 34 (shown in FIG. 4) extending parallel with the lower leg 30. To mount each bracket 26 on the respective upright, the heel 34 is inserted into one of the slots 24 of the respective upright while the toe 34 is received in an upper adjacent slot 24 of the same upright. Each bracket 26 is further provided with a stopper tab 36 projecting upward from the upper leg 28. The stopper tab 36 is struck from the upper leg 28 and thus is integral with the respective bracket 26.

The assembly 18 further includes a pair of opposed adapter members 40 formed also of folded sheet metal. Each adapter member 40 extends between the respective pair of front and rear uprights 20 and 22 with its opposite ends supported by the respective supporting brackets 26 on the uprights 20 and 22. FIGS. 2 and 3 illustrate the right adapter member 40. The left adapter member 40 is of a mirror-image structure of the right adapter member 40, but otherwise it is virtually identical to the right adapter member 40.

Each adapter member 40 comprises a generally wedge-shaped panel body 42, and upper and lower lateral flanges 44 and 46. The panel body 42 is disposed alongside the vertical plane in which the slotted side walls of the associated pair of uprights 20 and 22 lie. The upper lateral flange or shelf-mounting means 44 is formed entirely along the upper edge of the panel body 42 whereas the lower lateral flange 46 is formed only partially along the lower edge of the body 42 adjacent to its front end. These flanges 44 and 46 project inwardly from the inner side of the panel body 42. The upper flange 44 defines an acute angle with the lower flange 46. The angle between the upper and lower flanges 44 and 46 may be about 1 to 20 degrees, preferably about 2 to 18 degrees and most preferably about 7 to 9 degrees. This angle allows bottles on the shelf 16 to gravity feed forwardly as will be described later more fully.

The upper lateral flange 44 of each adapter member 40 is formed with two sets of apertures in a row. The apertures 48 of the front set are located near the front end of the respective adapter member 40 while the apertures 50 of the rear set are located near the rear end of that adapter member 40. The apertures of each set are arranged at equal spacings along the length of the lateral flange 44. The two sets of apertures are widely spaced from each other so that the intermediate portion of the flange 44 has no aperture.

The lower lateral flange 46 of each adapter member 40 is formed with stopper apertures 52 arranged at equal spacings along the length of the flange 46. As shown in FIG. 2, one of the stopper apertures 52 receives the stopper tab 36 of the front bracket 26 while the front end of the respective adapter member 40 rests on the front bracket 26. The lower edge of the adapter member 40 engages the rear bracket 26 at the portion between the respective stopper tab 36 and the rear upright 22 while the rear end of the adapter member 40 rests on the rear bracket 26. The above way of supporting the opposite ends of the adapter members 40 prevents horizontal displacement of the adapter members 40 as will be described later more fully.

As illustrated in FIG. 1, the shelf 16 is of a structure including a pair of front and rear horizontal cross members 54 and 56 and it is mounted at the opposite ends of the cross members 54 and 56 on the opposed adapter members 40. More specifically, the shelf 16 includes a plurality of parallel tracks 58 having their forward ends disposed between the front uprights 20 and extending backward from the forward ends. These tracks 58 are interconnected through the front and rear cross members 54 and 56 extending perpendicularly to the tracks 58. The tracks 58 are virtually identical to each other, and so are the front and rear cross members 54 and 56.

The tracks 58 are formed preferably of sheet metal or molded plastic. Each track 58 has a pair of longitudinally extending opposed side walls 60 joined together along their upper edges by a top wall 62 to form a channel-shaped body. A pair of parallel rails 64 are joined respectively along the lower edges of the side walls 60 so as to project inwardly of the respective track 58 toward each other. A space is maintained between the rails 64 of each pair to receive therein the necks of flanged bottles. The distance between the rails 64 is such that when bottle necks are received between the rails 64, the bottles are automatically arranged in a row and the undersides of the neck flanges engage the rails 64 to allow the bottles to be suspended for sliding movement along the respective track 58. Due to the wedge-shaped adapter members 40, the tracks 58 are held incline forwardly and downwardly. As a result, the suspended bottles gravity feed one after another to the forward end of each track 58 as the leading bottles on that track successively are removed from the track 58 through the forward end.

Typical flanged bottles used with the device of the invention may be soft drink bottles formed of plastic such as PET and having an integrally formed outwardly projecting annular flanges at their necks immediately under their caps. The bottles suspended from the tracks 58 are shown at "B" in dotted lines in FIG. 1. The detailed manner in which the bottles are suspended by their neck flanges is described in U.S. Pat. No. 5,586,687 owned by the assignee of the present application, which is hereby incorporated by reference.

The side walls 60 of each track 58 are provided at near each track end with a pair of opposed generally rectangular apertures (not shown). The forward end apertures of each track 58 receive the front cross member 54 so that the forward end portion of that track 58 is supported by the cross member 54. The rear end apertures of each track 58 receive the rear cross member 56 so that the rear end portion of that track 58 is supported by the cross member 56.

The front and rear cross members 54 and 56 are of a rectangular tube structure formed of metal or plastic. they passes transversely through all the tracks 58 in the shelf 16 as best shown in FIG. 1. The opposite ends of each cross member 54 and 56 are placed on and detachably secured to the upper lateral flanges 44 of the adapter members 40. More specifically, as shown in FIG. 3, each end of the front cross member 54 is formed with through holes 66 (only one shown in FIG. 3). A bolt 68 is inserted into the holes 66 as well as one of the apertures 48 of the front set in the flange 44. The lower end of the bolt 68 is allowed to project downward from the flange 44, and a nut 70 is engaged with the lower end of the bolt 68. In like manner, each end of the rear cross member 56 is formed with through holes 72 (only one shown in FIG. 3). A bolt 74 is inserted into the holes 72 as well as one of the apertures 50 of the rear set in the flange 44, and a nut 74 is engaged with the lower end of the bolt 74. The shelf 16 is thus detachably secured to the adapter members 40.

Instead of the bolts and nuts, any other conventional fasteners may be used to secure the shelf 16 to the adapter member 40. Alternatively, downwardly extending tabs may be integrally formed with the cross members for insertion into the apertures 48 and 50.

The above described merchandising device is assembled in the following manner.

First, each supporting bracket 26 is mounted in a pair of adjacent engaging slots 24 of the respective upright so that all the four brackets 26 lie in a horizontal plane at a desired elevation. Meanwhile, the adapter members 40 are secured to the shelf 16 so that each adapter member 40 interconnects the front and rear cross members 54 and 56 at the respective ends of the cross members 54 and 56. The apertures 48 and 50 which are used to secure the adapter members 40 are selected according to the given distance between the front and rear cross members 54 and 56. It is not necessary to adjust such a distance to the distance between the front and rear uprights 20 and 22. The adapter members 40 may be used with any shelf with its cross members spaced at a distance less than the length of the adapter members 40. Normally, the adapter members 40 extend forward beyond the front cross member 54 and rearward beyond the rear cross member 56.

The shelf 16 with the adapter members 40 thus secured is then placed on the supporting brackets 26 which have been mounted on the uprights 20 and 22. The right adapter member 40 is placed on one of the pairs of front and rear brackets 26 whereas the left adapter member 40 is placed on the other pair of brackets 26. The stopper apertures 52 in which the stopper tabs 36 of the front brackets 26 are received are selected so that the front ends of the tracks 58 do not interfere with the door of the cooler. If further positioning of the shelf 16 is required, the shelf 16 may be detached from the adapter members 40 and moved either forward or backward along the length of the adapter members 40 for relocation to a proper position along the adapter members 40.

Figure 4:
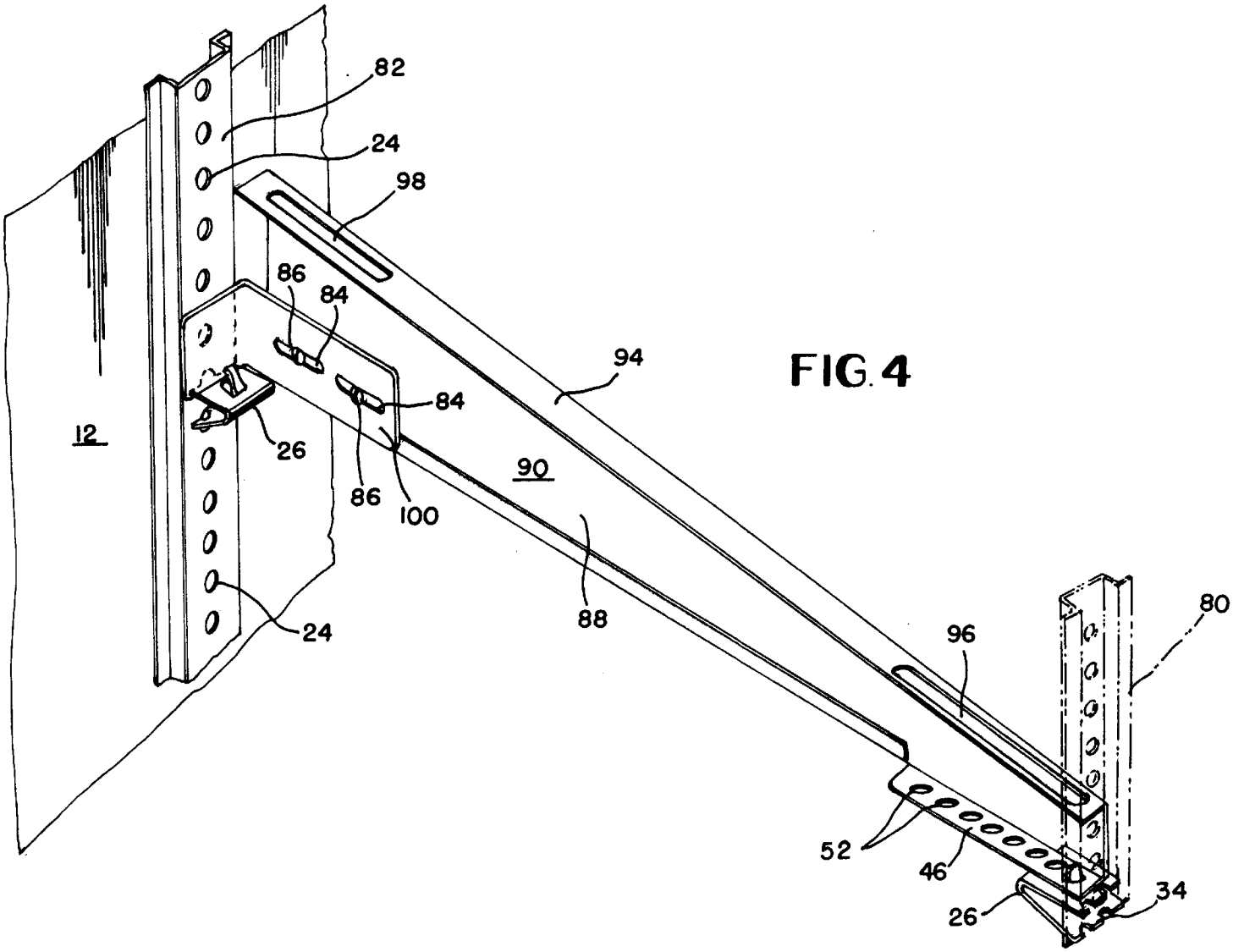
FIG. 4 is a perspective view of a shelf-mounting assembly of the second embodiment according to the invention.

FIG. 4 illustrates a second embodiment of the mounting assembly according to the invention. This assembly is partially identical to that in FIG. 2, and thus like reference numerals are used to indicate the corresponding portions. The assembly of this embodiment differs from that of FIG. 2 in that it is installed in a two-door cooler having four pairs of front and rear uprights for supporting two tiers of shelves. FIG. 4 illustrates one of the two intermediate pairs of front and rear uprights. The front upright 80 shown in a phantom line is secured to the rear side of a center strut (not shown) of the cooler whereas the rear upright 82 is secured to the back wall 12 of the cooler. Unlike the uprights 20 and 22 in FIG. 2, the uprights 80 and 82 have their slotted side walls facing each other. The adapter member 90 is extended between the front and rear uprights 80 and 82 with its opposite ends supported by the respective front and rear brackets 26 on the uprights 80 and 82.

More specifically, the panel body 88 of the adapter member 80 is disposed in a vertical plane generally perpendicular to the slotted side walls of the uprights 80 and 82. The lower lateral flange 46 rests on the front bracket 26 while the foremost stopper aperture 52 receives the stopper tab of the front bracket 26. An angle bracket or extension member 100 is slidably connected at its longer arm to the rear end of the adapter member 90. The longer arm of the angle bracket 100 allows the adapter member 90 to be substantially lengthened to reach both the front and rear uprights 80 and 82 while the shorter arm of the bracket 100 allows proper engagement between the adapter member 90 and the rear bracket 26. Slots 84 for slidably receiving bolts 86 are formed in the longer arm of the angle bracket 100. The bolts 86 are inserted into the slots 84 as well as holes (not shown) in the panel body 88 of the adapter member 90 and engaged at their ends with matching nuts (not shown). Alternatively, the panel body 88 may be formed with slots to allow similar slidable connection.

The assembly of this embodiment further differs from that of FIG. 2 in that the upper lateral flange 94 is provided with a pair of front and rear slots 96 and 98 rather than more than two apertures. The slots 96 and 98 are of utility in that a shelf may be slid along the adapter member 90 by loosening the fasteners such as 68 and 70 in FIG. 3 to relocate the shelf to a desired location.

Figure 5:
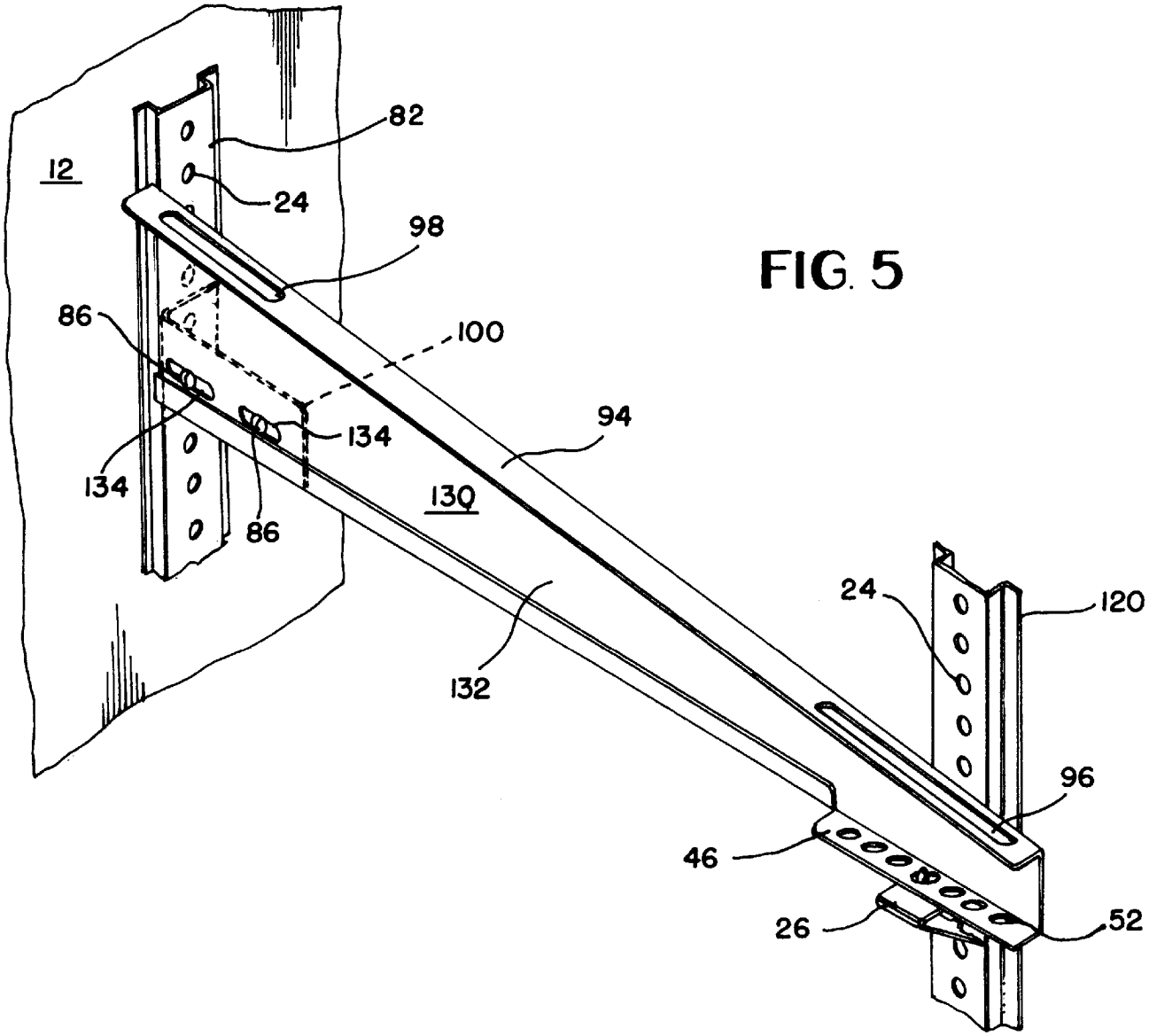
FIG. 5 is a perspective view of a shelf-mounting assembly of the third embodiment according to the invention.

FIG. 5 illustrates a third embodiment of the mounting assembly according to the invention. This assembly is partially identical to that in FIG. 4, and thus like reference numerals are used to indicate the corresponding portions. The assembly of this embodiment differs from that of FIG. 4 in that the front upright 120 is secured to the center strut (not shown) of the cooler such that the slotted side walls of the front and rear uprights 120 and 82 are disposed offset from and perpendicular to each other. The adapter member 130 is extended between the uprights 120 and 80 so that the panel body 132 is disposed parallel to the slotted side wall of the front upright 120 and perpendicular to the slotted side wall of the rear upright 82.

This assembly further differs from that of FIG. 4 in that the adapter member 130 is formed with slots 134 to slidably receive the bolts 86, and the angle bracket 100 is connected to the outer side of the adapter member 130 by means of the bolts 86. The longer arm of the angle bracket 100 may be formed with bolt holes instead of the slots such as shown in FIG. 4 at reference numeral 84. Although it is not clear from FIG. 5, the shorter arm of the angle bracket 100 is engaged at its lower edge with the rear bracket that is mounted in a pair of adjacent slots 24 in the rear upright 82.

It will be recognized that many variations may be made to the foregoing within the scope of the present invention. For example, adapter members with a constant vertical size such as generally rectangular members may be used instead of the wedge-shaped members 40 or 90. This, in other words, means that not only the gravity feed display shelves but also horizontal shelves may be mounted on the mounting assembly according to the present invention. The horizontal shelves may be those for supporting articles on their upper sides or those from which articles are suspended.

It should be also recognized that the apertures 48 and 50 in FIGS. 2 and 3 may be arranged in one set entirely along the lateral flange 44 rather than in two separate sets. Likewise, the slots 96 and 98 in FIG. 4 may be formed continuous with each other so that a single slot extend along the flange 94.

It should be further recognized that any other conventional supporting bracket may be used instead of the brackets 26. Such other conventional brackets include those each mountable on an upright using only one of the engaging slots in the upright.

What is claimed is:

1. A shelf-mounting assembly comprising:

a shelf-engaging fastener;

front and rear opposed uprights, each having a plurality of engaging slots disposed therealong at vertical spacings; and an adapter member extending between said front and rear uprights and connected to each of said front and rear uprights by means of one or more of said engaging slots of said each upright whereby said adapter member is supported at a selected elevation, said adapter member comprising a shelf-mounting flange formed along said adapter member, said flange having means for detachably and movably receiving said fastener for relocation to different positions along said flange whereby a shelf may be mountable at different positions along said adapter member.

2. The assembly according to claim 1, further comprising a supporting bracket detachably mounted in said one or more engaging slots of said each upright to support a lower edge of said adapter member.

3. The assembly according to claim 2, wherein each of said supporting brackets has a stopper tab upwardly projecting therefrom, and said adapter member has a stopper aperture for receiving said tab of at least one of said supporting brackets to prevent horizontal displacement of said adapter member.

4. The assembly according to claim 1, wherein said receiving means comprises a plurality of apertures arranged along the length of said flange to receive said fastener.

5. The assembly according to claim 4, further comprising a supporting bracket detachably mounted in said one or more engaging slots of said each upright and supporting a lower edge of said adapter member, said flange defining an acute angle with said lower edge of said adapter member.

6. The assembly according to claim 5, wherein said adapter member has a generally wedge-shaped panel body having an upper edge opposed to said lower edge, said flange being formed along said upper edge.

7. The assembly according to claim 1, wherein said receiving means comprises a slot extending along the length of said flange to slidably receive said fastener.

8. The assembly according to claim 7, further comprising a supporting bracket detachably mounted in said one or more engaging slots of said each upright and supporting a lower edge of said adapter member, said flange defining an acute angle with said lower edge of said adapter member.

9. The assembly according to claim 8, wherein said adapter member has a generally wedge-shaped panel body having an upper edge opposed to said lower edge, said flange being formed along said upper edge.

10. The assembly according to claim 1, further comprising an extension member connected to said adapter member for movement along the length of said adapter member so that the substantial length of said adapter member may be adjustable.

11. A merchandising device comprising:

a display shelf having fastening means associated therewith;

front and rear opposed uprights, each having a plurality of engaging slots disposed therealong at vertical spacings; and an adapter member extending between said front and rear uprights and connected to each of said front and rear uprights by means of one or more of said engaging slots of said each upright whereby said adapter member is supported at a selected elevation, said adapter member comprising shelf-mounting means for connecting said shelf to said adapter member so that said shelf may be relocatable to different positions along said adapter member, said shelf mounting means comprising a lateral flange formed along said adapter member, said lateral flange having means for detachably and movably receiving said fastening means for relocation to different positions along said lateral flange.

12. The device according to claim 11, said receiving means comprises a plurality of apertures arranged along the length of said lateral flange to receive said fastening means.

13. The device according to claim 11, said receiving means comprises a slot extending along the length of of said lateral flange to slidably receive said fastening means for movement therealong.

14. The device according to claim 11, wherein said shelf comprises a pair of front and rear opposed cross members extending generally perpendicularly to said adapter member, each of said cross members being connected at one end thereof to said adapter member by said shelf-mounting means.

15. The device according to claim 14, wherein said shelf comprises a track mounted on said front and rear cross members and disposed generally parallel to said adapter member to support a row of articles, said track defining a path extending therealong such that said articles are movable along said path and are removable from said path via a forward end of said track.

16. The device according to claim 15, further comprising a supporting bracket detachably mounted in said one or more engaging slots of said each upright and supporting a lower edge of said adapter member, said lateral flange being formed along an upper edge of said adapter member, said lateral flange defining an acute angle with said lower edge of said adapter member so that said track is inclined forwardly and downwardly whereby said articles when supported by said track are allowed to gravity feed forwardly along said path.

17. A method of mounting a shelf having a pair of front and rear opposed cross members onto a supporting structure having two pairs of front and rear opposed uprights, each of said uprights having a plurality of engaging slots disposed therealong at vertical spacings, said method comprising the steps of:

mounting a supporting bracket in one or more of said engaging slots of said each upright;

securing a pair of adapter members to said shelf so that each of said adapter members interconnects said front and rear cross members at respective ends of said front and rear cross members and extends generally perpendicularly to said front and rear cross members; and placing said shelf on said supporting brackets such that lower edges of said adapter members are engaged and supported by said supporting brackets; a shelf-mounting flange formed along said adapter member, said flange having means for detachably and movably receiving a shelf engaging fastener for relocation to different positions along said flange whereby said shelf is mounted on said supporting structure without adjusting the distance between said front and rear cross members.

18. The method according to claim 17, wherein said mounting step comprises mounting said supporting brackets in said one or more engaging slots so that said brackets lie in a horizontal plane, said each adapter member having a lateral flange formed along an upper edges thereof, said securing step comprising securing said lateral flange of said each adapter member to said shelf, said lateral flange of said each adapter member defining an acute angle with said lower edge of respective one of said adapter members so that when placed on said supporting brackets, said shelf is inclined forwardly and downwardly.

* * * * *